US011305304B2

(12) United States Patent
Kantor

(10) Patent No.: US 11,305,304 B2
(45) Date of Patent: Apr. 19, 2022

(54) ROTATING SPRINKLER

(71) Applicant: METZERPLAS COOPERATIVE AGRICULTURAL ORGANIZATION LTD., M. P. Heffer (IL)

(72) Inventor: Isaak Kantor, Rosh Pina (IL)

(73) Assignee: METZERPLAS COOPERATIVE AGRICULTURAL ORGANIZATION LTD., M.P. Heffer (IL)

( * ) Notice: Subject to any disclaimer, the term of this patent is extended or adjusted under 35 U.S.C. 154(b) by 0 days.

(21) Appl. No.: 17/051,228

(22) PCT Filed: Apr. 17, 2019

(86) PCT No.: PCT/IL2019/050440
§ 371 (c)(1),
(2) Date: Oct. 28, 2020

(87) PCT Pub. No.: WO2019/215716
PCT Pub. Date: Nov. 14, 2019

(65) Prior Publication Data

US 2021/0129163 A1 May 6, 2021

Related U.S. Application Data

(60) Provisional application No. 62/762,548, filed on May 9, 2018.

(51) Int. Cl.
*B05B 3/04* (2006.01)
*B05B 15/74* (2018.01)

(52) U.S. Cl.
CPC ..... *B05B 3/0486* (2013.01); *B05B 15/74* (2018.02); *B05B 3/0481* (2013.01)

(58) Field of Classification Search
CPC ..... B05B 15/74; B05B 3/16; B05B 3/0486; B05B 3/0481; B05B 3/021; B05B 3/0459; B05B 3/0472
See application file for complete search history.

(56) References Cited

U.S. PATENT DOCUMENTS 1,593,918 A 7/1926 Stanton
2,708,598 A * 5/1955 Stary ..... B05B 3/0472 239/231

(Continued)

FOREIGN PATENT DOCUMENTS

EP 1967279 A1 9/2008
GB 2242107 A 9/1991

OTHER PUBLICATIONS

International Search Report for PCT/IL2019/050440, dated Aug. 12, 2019, 5 pages.

(Continued)

*Primary Examiner* — Steven M Cernoch
(74) *Attorney, Agent, or Firm* — Roach Brown McCarthy & Gruber, P.C.; Kevin D. McCarthy

(57) ABSTRACT

A rotating sprinkler is configured with only three components without need of any other manufactured component. The three components are constituted by a base component connected to a water source, a rotating head component from which a water stream is emitted which is rotatably mounted on an element of the base component, and a gravitating hammer component pivotally mounted on the head component that causes intermittent rotary motion of the head component about a vertical rotation axis by intermittently engaging the emitted stream and providing in response a reaction force. The hammer component is configured to intercept the emitted water stream within an interior space between a deflecting surface and a ramping surface when downwardly pivoted and to urge the intercepted water stream to flow upwardly along the ramped surface and to impinge upon the deflecting surface, causing the hammer component to pivot upwardly prior to being gravitated.

2 Claims, 13 Drawing Sheets

(56) References Cited

U.S. PATENT DOCUMENTS

| | | | |
|---|---|---|---|
| 2,877,053 | A | 3/1959 | Kennard |
| 3,986,671 | A | 10/1976 | Nugent |
| 4,235,379 | A | 11/1980 | Beamer |

OTHER PUBLICATIONS

Written Opinion of the International Searching Authority for PCT/IL2019/050440, dated Aug. 12, 2019, 4 pages.
Communication and Supplementary European Search Report for EP 19 79 9595, dated Jan. 25, 2022 (5 pages).

* cited by examiner

ROTATING SPRINKLER

FIELD OF THE INVENTION

The present invention relates to the field of irrigation apparatus. More particularly, the invention relates to a rotating sprinkler.

BACKGROUND OF THE INVENTION

Various rotating sprinklers for spraying water around their vertical axis are known from the prior art. These prior art sprinklers are configured with various mechanical components such as a nozzle, gear, spring, bearing and turbine that add cost to the apparatus and complexity to fabrication and installation procedures.

It is an object of the present invention to provide a rotating sprinkler that can be cost effectively fabricated and installed.

It is an additional object of the present invention to provide a rotating sprinkler that reliably produces a circular wetted area of a predetermined dimension.

Other objects and advantages of the invention will become apparent as the description proceeds.

SUMMARY OF THE INVENTION

An impact-type rotating sprinkler configured with only three components without need of any other manufactured component connected, added or coupled to any one or more of said three components, said three components being constituted by a base component connected to a water source, a rotating head component from which a water stream is emitted which is rotatably mounted on a vertical tubular element of said base component, and a gravitating hammer component pivotally mounted on said head component that causes intermittent rotary motion of said head component about a vertical rotation axis by intermittently engaging the emitted stream and providing in response a reaction force.

In one aspect, the gravitating hammer component comprises a deflecting surface and a ramping surface oriented obliquely with respect to said deflecting surface to define an interior space between said deflecting surface and said ramping surface, the gravitating hammer component configured to intercept the emitted water stream within said interior space when downwardly pivoted and to urge the intercepted water stream to flow upwardly along said ramped surface and to impinge upon said deflecting surface, causing the hammer component to pivot upwardly prior to being gravitated.

In one aspect, the gravitating hammer component is pivotally mountable on, and displaceable about, one or more horizontally oriented mounting elements of the head component, pivotal displacement of the gravitating hammer component being limited by two spaced stoppers protruding from the head component.

In one aspect, one of the two stoppers limits the gravitating hammer component to a downwardly pivoted position at which it is configured to intercept the emitted water stream.

In one aspect, the head component is configured with a discharge port and with a channel along which water from the water source is flowable and directable through said discharge port to the ramping surface when the gravitating hammer component is disposed at the downwardly pivoted position.

In one aspect, the gravitating hammer component is configured with one or more guiding surfaces protruding from the deflecting surface which urge the intercepted water stream to flow along a specific path forwardly to an impingement region until exiting the gravitating hammer component from said path in a direction that is tangential to the tubular element, a direction of the reaction force causing rotation of the head component being opposite to the direction of flow of the exiting water.

In one aspect, the gravitating hammer component is pivotally displaceable more than 90 degrees with respect to the downwardly pivoted position while the head component rotates in a same rotational direction regardless of an orientation of the gravitating hammer component.

In one aspect, the gravitating hammer component comprises first and second oppositely oriented ramping surfaces and is invertable, and first and second sets of guiding surfaces protruding from opposite faces of the deflecting surface which are configured to urge the water stream intercepted by the first and second ramping surfaces, respectively, to flow along the specific path.

In one aspect, the head component is configured with first and second opposite discharge ports and with first and second channels by which water from the water source is divided and directed to said first and second discharge ports and to the first and second ramping surfaces, respectively, when the gravitating hammer component is disposed at a corresponding downwardly pivoted position.

The following are some of the advantages of the rotating sprinkler:

- By comprising only three components, the sprinkler is easily and quickly assembled and therefore has an inexpensive cost.
- When manufactured entirely from plastic materials, the sprinkler can be recycled.
- The sprinkler is not susceptible to clogging by virtue of its large water passages.
- It provides quiet operation.
- The sprinkler reliably produces a circular wetted area of a predetermined dimension which can be adjusted by replacing one of its components with a differently sized component.

DETAILED DESCRIPTION OF THE INVENTION

An impact-type rotating sprinkler comprises only three components, namely a base component connected to the water source, a rotating head component mounted on the base component from which a water stream is emitted, and a gravitating hammer component pivotally mounted on the head component that induces the rotary motion by intermittently engaging the emitted stream and providing in response to the engagement a reaction force causing intermittent rotation of the head component about a vertical rotation axis. The sprinkler does not require any other manufactured component to ensure reliable sprinkler rotation and substantially uniform application of water to a circular area, with the exception of the fittings connected to the water source. The three components may be cost effectively made of injected molding plastic, or of metallic material. Each component may be integrally formed or manufactured by connecting individual elements.

The rotating sprinkler is advantageously self-propelled by the hydraulic force provided by a water supply system and the gravitational force to which the pivoting hammer component is subjected. The sprinkler is operational with respect to a large range of water pressure, e.g. 0.5-6.0 bars, and a large range in volumetric flow rate, e.g. 100-3000 l/h, in accordance with a consumer's needs or in accordance with given conditions of a field.

FIGS. 1-10 illustrate a first embodiment of a rotating sprinkler, generally indicated by numeral 10.

Figure 1:
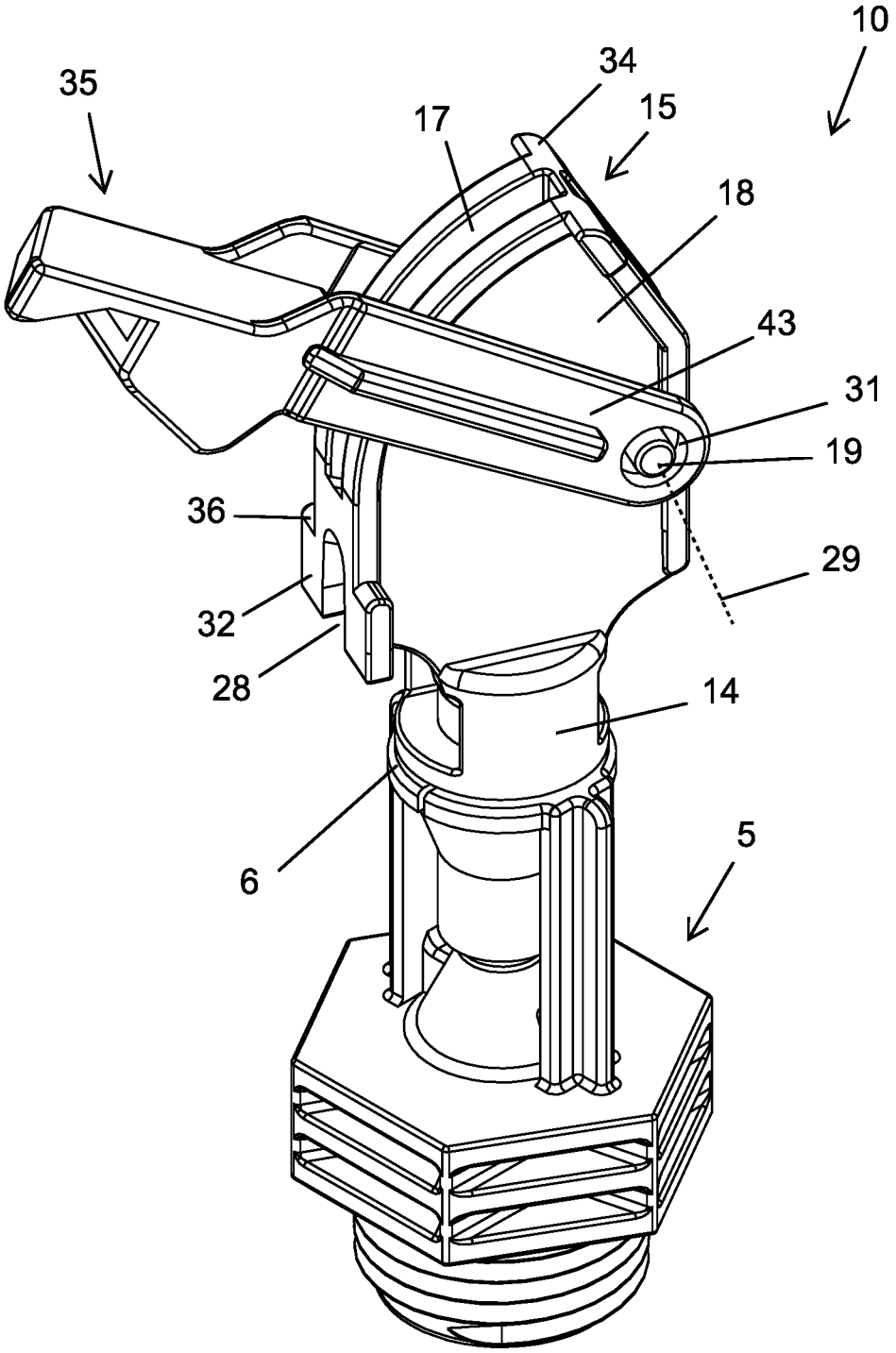
FIG. 1 is a perspective view from the front and top of an embodiment of an assembled rotating sprinkler, showing the hammer component in an intermediate pivoted position.

An assembled sprinkler 10 is shown in FIG. 1. Base component 5 has a retaining ring 6 which is in movable contact with an element of the lower coupling section 14 of head component 15 to maintain rotary movement of the head component about a vertical axis. Two mutually parallel upper plates 17 and 18 of head component 15 vertically extend above the lower coupling section 14, and a short post 19 extends perpendicularly and outwardly, i.e. in a direction away from the interspace between the two parallel plates, from a corresponding plate. Mounting arm 43 of gravitating hammer component 35, which is substantially parallel to plates 17 and 18, is coupled with a corresponding post 19 by an aperture 31 formed at a terminal end thereof, allowing gravitating hammer component 35 to pivot about a horizontal axis 29 passing through the two posts 19. A water stream is emitted from a discharge port 28, for example inverted U-shaped, which is formed in an interconnecting wall 32, e.g. planar, extending between a lower region of plates 17 and 18.

Figure 2:
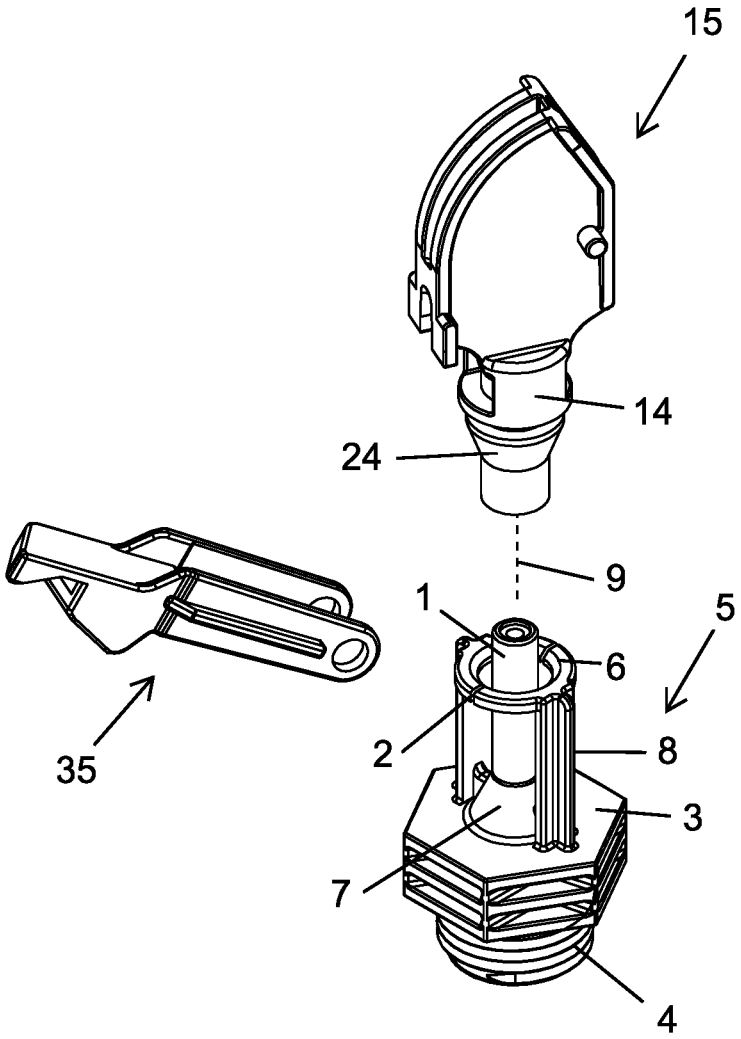
FIG. 2 is an exploded view of the sprinkler of FIG. 1.

As shown in FIG. 2, retaining ring 6 of base component 5 is connected by a set of vertical posts 8, e.g. two diametrically opposite posts of a T-shaped cross section, to an underlying planar base 3, which may be one of the three vertically spaced bases, located above a threaded pipe fitting 4. A mounting tube 1 positioned centrally to retaining ring 6 projects from base 3 via an inverted frustoconical interface element 7 to a height above retaining ring 6, and its axis is the vertical axis 9 about which coupling section 14 of head component 15 rotates.

Figure 3:
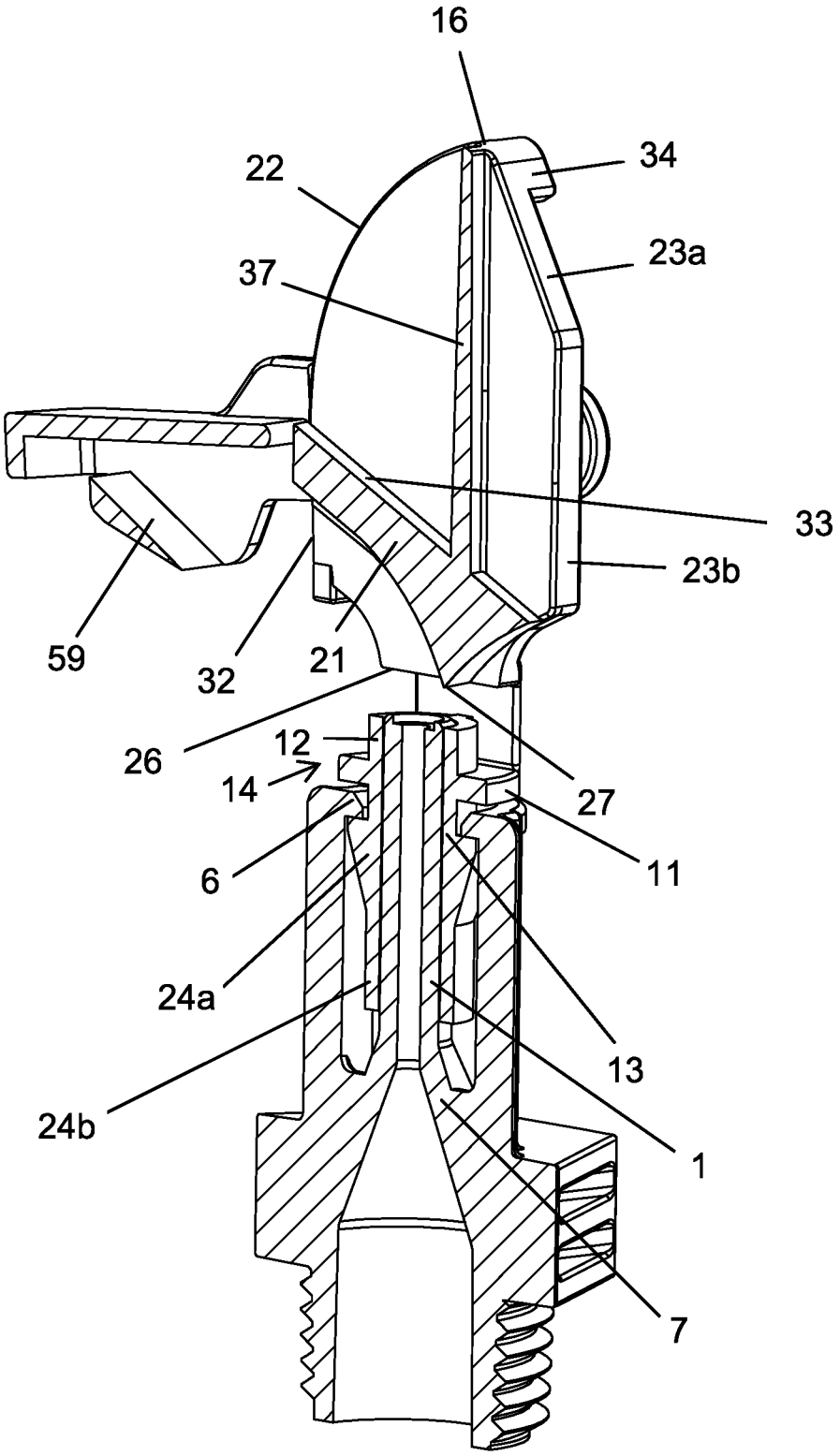
FIG. 3 is a perspective, vertical cross sectional view of the sprinkler of FIG. 1, cut along a plane between two plates of the head component, showing the hammer component in a downward pivoted position.

Coupling section 14 may be configured with a lowermost annular frustoconical coupler 24 made of elastomeric material. Although the radial dimension of the lower portion **24*b* of the coupler is less than the radial clearance between retaining ring 6 and mounting tube 1 of base component 5 and the radial dimension of the upper thickened portion 24*a* of the coupler is significantly greater than the radial clearance, as shown in FIG. 3, application of a downward force onto head component 15 causes compression of upper portion 24*a*, until the coupler is introduced between the vertical gap between retaining ring 6 and interface element 7. An audible clicking sound may be generated during compression of upper portion 24*a* as it applies a force to retaining ring 6, which may be formed with a dedicated circumferential gap 2 shown in FIG. 2** whose two ends may be forced together to cause the clicking sound when the compression-derived force is applied.

Annular coupling section 14 also has a substantially horizontal surface 11 located above upper portion **24*a* of the coupler which is abuttable with retaining ring 6 to prevent unwanted vertical movement of head component 15, an upper throat portion 12 located directly above, and of a significantly smaller radial dimension than, surface 11, and short extension element 13 extending between horizontal surface 11 and the coupler and which is contactable by retaining ring 6**.

Following introduction of the coupler, upper portion **24*a* expands and is able to contact the underside of retaining ring 6, to assist in resisting disengagement of coupling section 14 from retaining ring 6. The radially inner surface of the entire coupling section 14, including throat portion 12, horizontal surface 11, extension element 13 and coupler portions 24*a-b* is in movable contact with mounting tube 1, thus facilitating rotation of head component 15 while extension element 13 is retained within the annular space between mounting ring 1 and retaining ring 6**.

Figure 4:
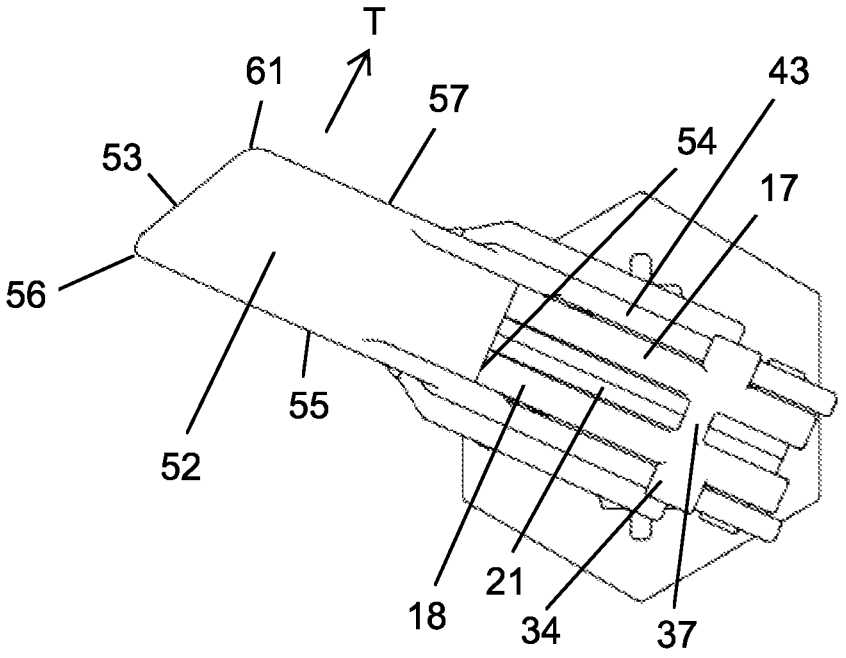
FIG. 4 is a top view of the sprinkler of FIG. 1, schematically illustrating a rotation-producing reaction force transmitted from the hammer component to the head component.

With reference to FIGS. 1 and 3, the inward face of each of the plates 17 and 18 of head component 15, i.e. opposite to the outward direction, is configured with an arcuate guide element 21, e.g. concave, for guiding the water discharged upwardly from mounting tube 1 along a channel to discharge port 28. The corresponding guide element 21 of plates 17 and 18 is in abutting relation with each other, as shown in FIG. 4, and consequently confines the discharged water along a desired path.

The wall of arcuate guide element 21 extends from a junction 27, e.g. a pointed junction, coinciding with bottom straight edge 26 of the plate to interconnecting wall 32, at a region thereof that is located above and adjoins discharge port 28. Junction 27 is spaced to the side of the upper end of mounting tube 1 to ensure that all the water discharged from mounting tube 1 will be directed to discharge port 28. Bottom straight edge 26 may be vertically spaced upwardly from the outlet of mounting tube 1.

Each plate has an arcuate side edge 22 that follows the path of the gravitating hammer component as it pivots about axis 29 and a set of opposite differently angled straight side edges 23*a-b*. Arcuate side edge 22 extends upwardly and continuously from an upper region of planar interconnecting wall 32, at which it coincides with an upper straight edge 33 of guide element 21. Arcuate side edge 22 and straight side edge 23*a* coincide at summit 16, to define a plate having a height between summit 16 and bottom straight edge 26 that is approximately equal to 1.5 times its width between side edge 23*a* and interconnecting wall 32. A vertical reinforcing rib 37 that is integral with both plates 17 and 18 extends upwardly from upper straight edge 33 of guide element 21 to summit 16. A stopper element 34 for limiting the upward pivotal displacement of a corresponding mounting arm 43 of hammer component 35 extends slightly outwardly from the summit 16 of each plate. Head component 10 has a second, upwardly extending stopper 36 which is integral with interconnecting wall 32 and positioned slightly outwardly to discharge port 28, for limiting the downward pivotal displacement of a corresponding mounting arm 43.

Gravitating hammer component 35 will now be described with reference to FIGS. 4-8. Since hammer component 35 is pivotable, it will be described as having first and second edges that are generally radially extending with respect to axis 29 about which the hammer component pivots. The first and second edges are referred to herein as being spaced "laterally", or in a direction substantially perpendicular to the radial direction. "Distally" means in a lateral direction away from a post-receiving aperture 31, and "proximally" means in a lateral direction towards a post-receiving aperture 31.

Figure 6:
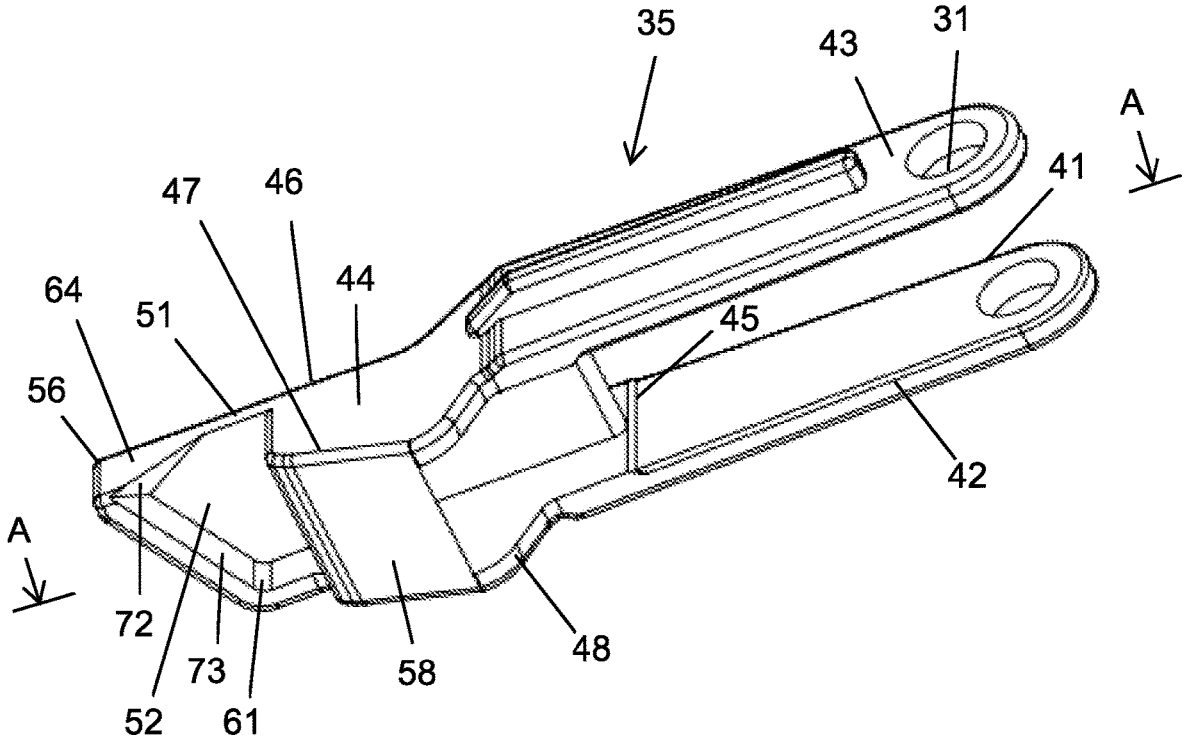
FIG. 6 is a perspective view from the bottom and front of the hammer component of FIG. 1.

As shown in FIG. 6, hammer component 35 comprises two spaced and elongated radially extending mounting arms 43 for pivotal mounting on a corresponding post 19 located close to a straight plate edge 23*b*, and two opposite and identical sidewall portions 44 extending continuously and forwardly, i.e. axially away from post-receiving aperture 31, from a corresponding mounting arm 43. A planar deflecting surface 52 for facilitating upward pivotal displacement of the hammer component is positioned between, projects forwardly from, and is aligned with, the first edge 46 of each sidewall portion 44. Deflecting surface 52 may terminate rearwardly at a discontinuity 45 between sidewall portion 44 and the corresponding mounting arm 43. A ramp 58 for directing the emitted water stream onto deflecting surface 52 is positioned between the second edge 47 of each sidewall portion 44.

Although not readily seen in the perspective view of FIG. 1, deflecting surface 52 has a non-rectangular configuration that has a forward edge 53 which is oblique with respect to its rearward laterally extending edge 54, as shown in FIGS. 4-8, such that a coincidence region 56 between forward edge 53 and side edge 55, which corresponds to and is spaced outwardly from plate 18, is spaced forwardly to coincidence region 61 between forward edge 53 and side edge 57, which corresponds to and is spaced outwardly from plate 17. A forward wall 62 for confining the deflected water is substantially perpendicular to deflecting surface 52, and extends distally from forward edge 53.

Two sidewall portions 51 and 64 of a smaller lateral dimension than sidewall portion 44 are positioned forwardly thereto. Sidewall portion 51 is continuous with sidewall portion 44, and sidewall portion 44 is continuous with sidewall portion 64, the proximal edge of each sidewall portion coinciding one with the other. While sidewall portion 51 is thin and its distal edge is substantially parallel to its proximal edge, sidewall portion 64 is triangular, and its distal edge extends from the distal edge of sidewall portion 51 to the distal edge of coincidence region 56. The distal edge of coincidence regions 56 and 61, sidewall portion 64 and forward wall 62 may be coplanar.

Two sloped surfaces 72 and 73 that may be spatially oriented with respect to deflecting surface 52 in different ways serve to direct the deflected water. The first side of triangular sloped surface 72 coincides with the distal edge of the sidewall portion 64 that is contiguous with coincidence region 56, the second side coincides with deflecting surface 52, and the third side coincides with elongated sloped surface 73. Elongated sloped surface 73 extends the entire length of forward wall 62.

Figure 7:
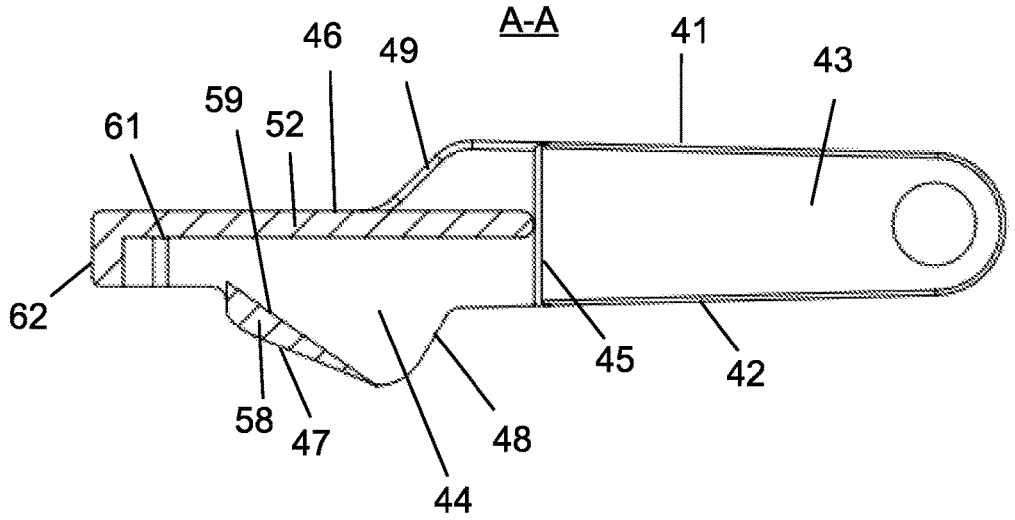
FIG. 7 is a cross sectional view of the hammer component of FIG. 6, cut along plane A-A of FIG. 6.
Figure 8:
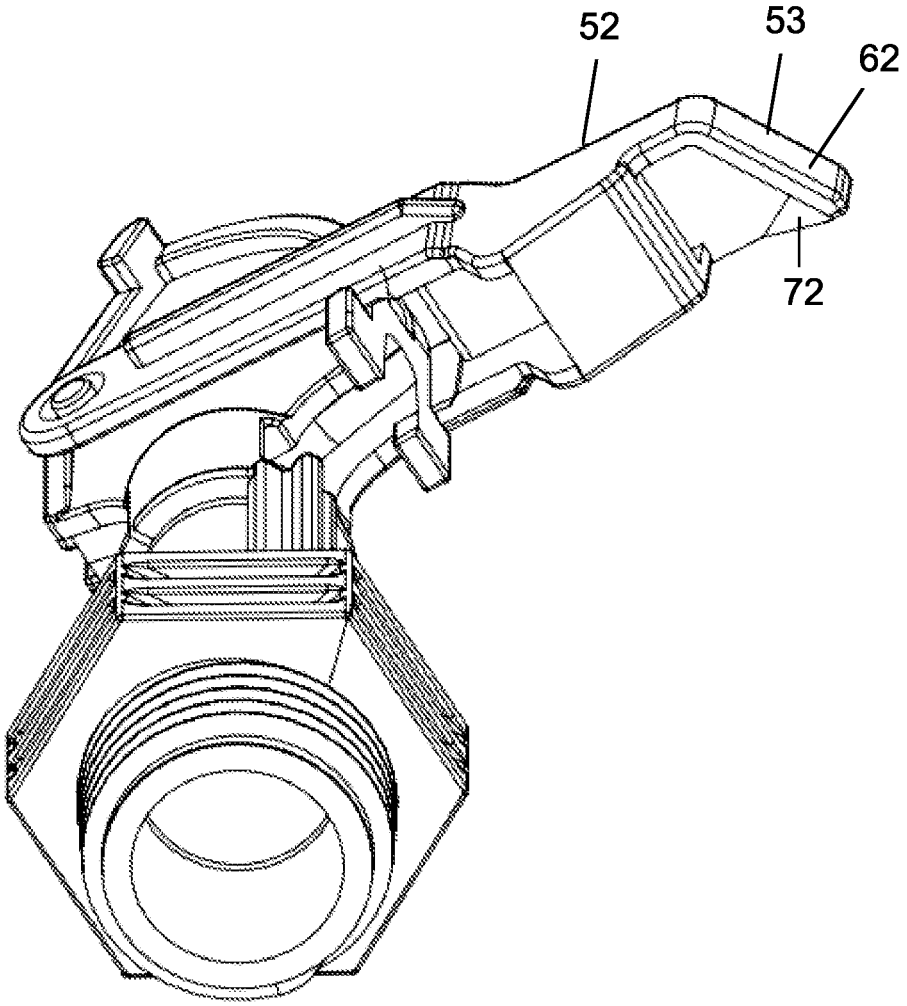
FIG. 8 is a perspective view from the bottom of the sprinkler of FIG. 1.

In order to accommodate ramp 58, sidewall portion 44 may be distally, and also inwardly, offset from the corresponding mounting arm 43, and second distal edge 47 of sidewall 44 may be inclined with respect to first proximal edge 46 thereof, as shown more clearly in FIG. 7. A convex edge 48 may interface between second edge 47 of sidewall portion 44 and second edge 42 of the corresponding mounting arm 43. An inclined edge 49, or alternatively a convex edge, may interface between first edge 46 of sidewall portion 44 and first edge 41 of the corresponding mounting arm 43. Ramp 58 has a thickened wall whose proximal ramped surface 59, clearly shown in FIG. 3, may be disposed at a different angular orientation than second edge 47 of sidewall 44.

Figure 9:
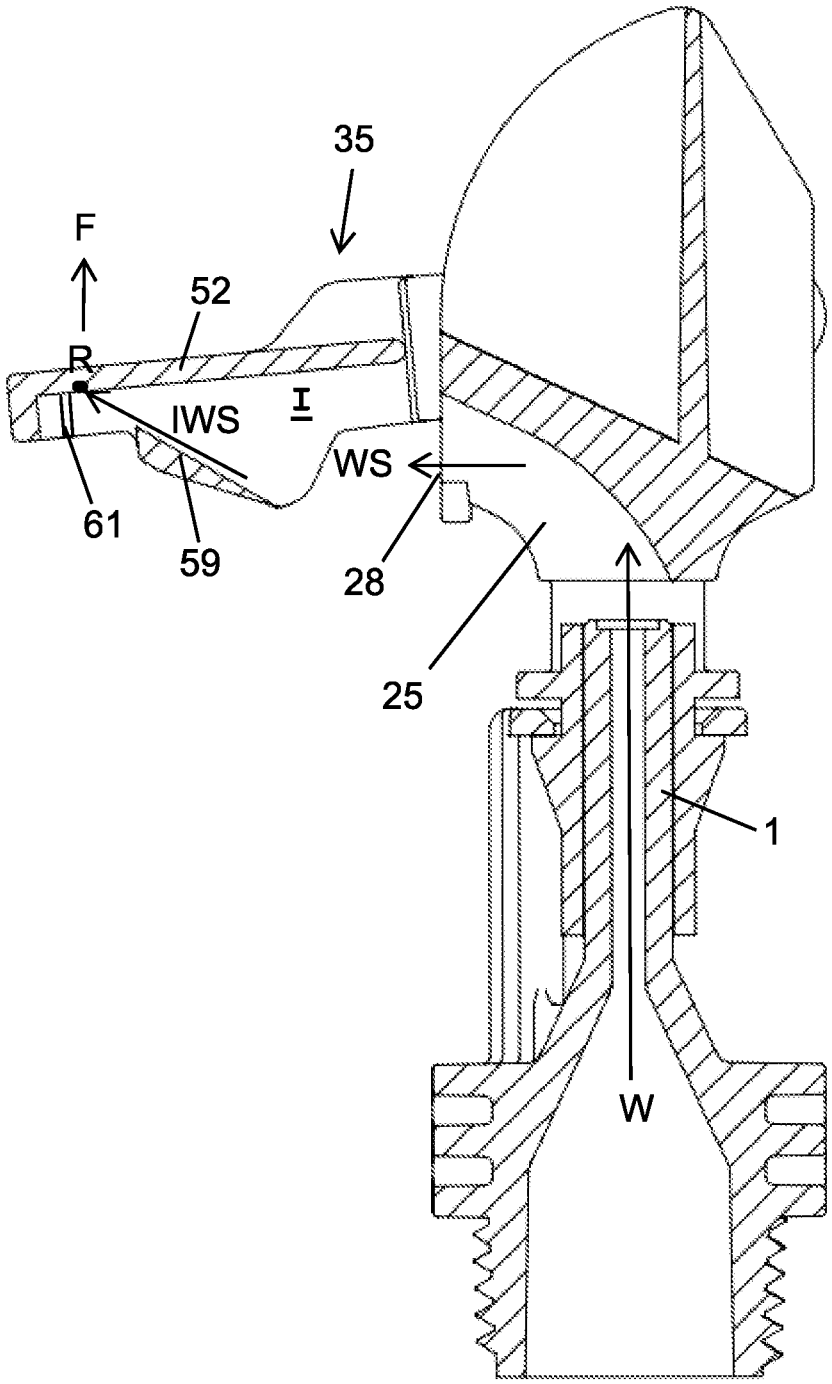
FIG. 9 is a vertical cross sectional view of the sprinkler of FIG. 1, cut along a plane between two plates of the head component, schematically illustrating an intercepting operation performed by the hammer component and the resulting upwardly pivoting action.

FIG. 9 illustrates hammer component 35 when oriented at the lowermost pivoted position, following contact between distal edge 42 of each mounting arm 43 and the corresponding stopper 36 (FIG. 1). Water W flowing through mounting tube 1, generally received from a water supply system, is discharged to upwardly and convexly curved channel 25 defined by guide element 21, and is consequently directed to discharge port 28, from which water stream WS is emitted. Hammer component 35 at the lowermost pivoted position intercepts water stream WS through the interior volume I between deflecting surface 52 and ramped surface 59. The intercepted water stream IWS is urged to flow upwardly along ramped surface 59 and to impinge upon deflecting surface 52 at a widthwise impingement region R forwardly to ramp 58, which may coincide with coincidence region 61. The force applied by the impinging water onto deflecting surface 52 has a component F that causes hammer component 35 to pivot upwardly.

Figure 5:
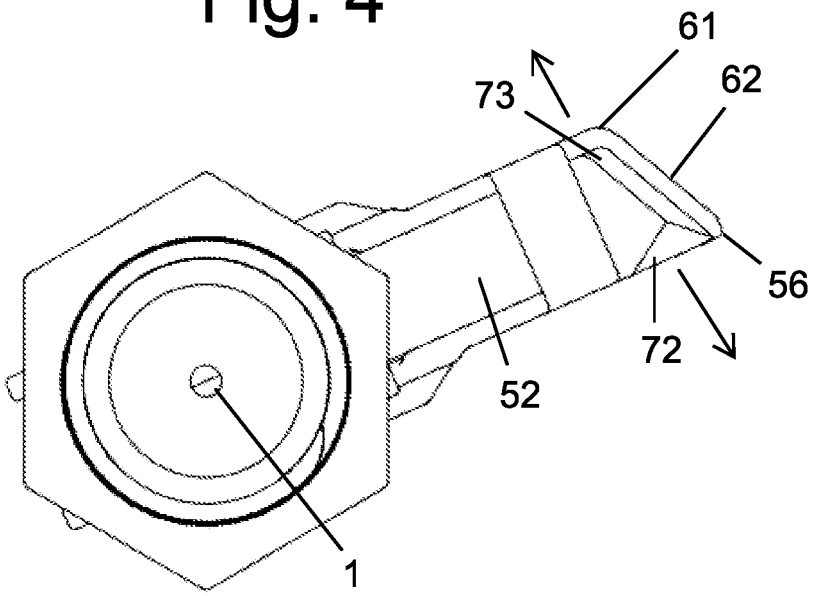
FIG. 5 is a bottom view of the sprinkler of FIG. 1, schematically illustrating a flow of water exiting the hammer component and an oppositely directed rotation-producing reaction force transmitted from the hammer component to the head component.

While hammer component 35 is upwardly pivoting and the orientation of deflecting surface 52 is continuously changing, water that is deflected following contact at impingement region R is exposed to sloped surface 73, and is consequently urged to flow forcefully along sloped surface 73 towards coincidence region 56. This outwardly flowing deflected water, through the interaction of sloped surface 72 which changes the direction of flow, exits hammer component 35 via the distal edge of the contiguous sidewall component 64. A reaction force T having a component that is opposite in direction to the direction of the exiting water EW and tangential to mounting tube 1, as shown in FIGS. 4 and 5 is produced, causing head component 15 to rotate a limited circumferential distance about mounting tube 1.

Water stream WS continues to be emitted while hammer component 35 is upwardly pivoting. Due to the change in orientation of ramped surface 59, intercepted water stream IWS impinges upon deflecting surface 52 at an impingement region R closer to mounting arm 43. The deflected water then flows downwardly along the inclined deflecting surface 52 and is discharged. Eventually hammer component 35 is significantly upwardly pivoted and interior volume I ceases to intercept water stream WS. Nevertheless water stream WS apples an upwardly directed force to ramp 58.

Figure 10:
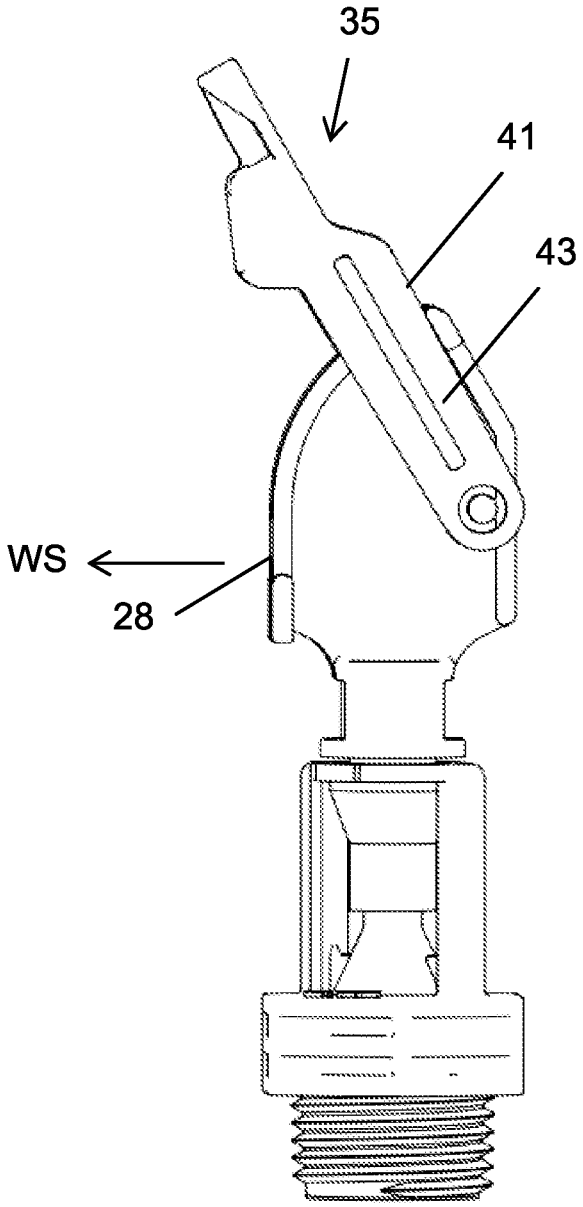
FIG. 10 is a front view of the sprinkler of FIG. 1, showing the hammer component in an upward pivoted position.

Hammer component 35 therefore continues to be upwardly pivoted, through the influence of the upwardly directed force F and of inertia until assuming the extreme upwardly pivoted position shown in FIG. 10 at which proximal edge 41 of mounting arm 43 contacts stopper 34 (FIG. 1). Water stream WS is shown to be continuously emitted through discharge port 28.

Following impact with stopper 34, hammer component 35 gravitates towards discharge port 28 in order to perform another cycle of water stream interception, transmission of a tangential force relative to the mounting tube to cause intermittent rotation of head component 15, and upwardly pivoted displacement.

Figure 11:
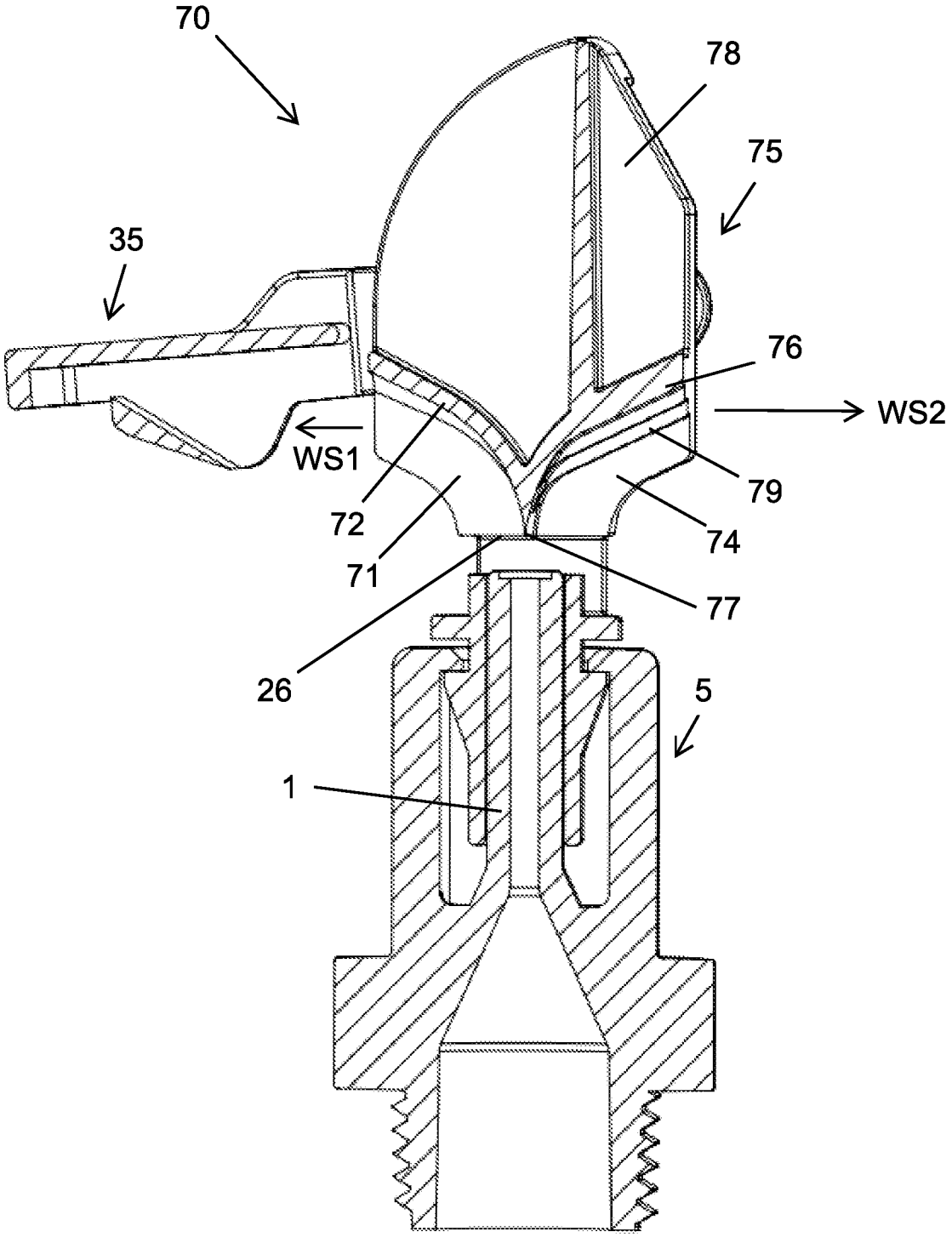
FIG. 11 is a vertical cross sectional view of another embodiment of a rotating sprinkler, cut along a plane between two plates of the head component, showing the hammer component in a downward pivoted position.

A second embodiment of a rotating sprinkler 70 is illustrated in FIG. 11.

Sprinkler 70 comprises the same base component 5 and hammer component 35 as sprinkler 10 of FIG. 1, as well as a head component 75 similar to head component 15 of FIG. 1 but configured with two convexly curved channels 71 and 74 defined by arcuate guide elements 72 and 76, respectively.

Junction 77, e.g. a pointed junction, coinciding with bottom straight edge 26 of the plate 78 is located above the upper end of mounting tube 1 to ensure that all the water discharged from mounting tube 1 will be separated into two flows, a first flowing through channel 71 to discharge port 82 from which first water stream WS1 is emitted and a second flowing through channel 74 to discharge port 84 from which second water stream WS2 is emitted.

The function of gravitating hammer component 35 with respect to water stream WS1 is the same as described above. Water stream WS2 is unaffected by hammer component 35, and therefore provides a uniform wetted area. The water distribution provided by water stream WS2 may be improved by stepped discontinuities 79 provided within channel 74.

A third embodiment of a rotating sprinkler 90 is illustrated in FIGS. 12-18.

Figure 12:
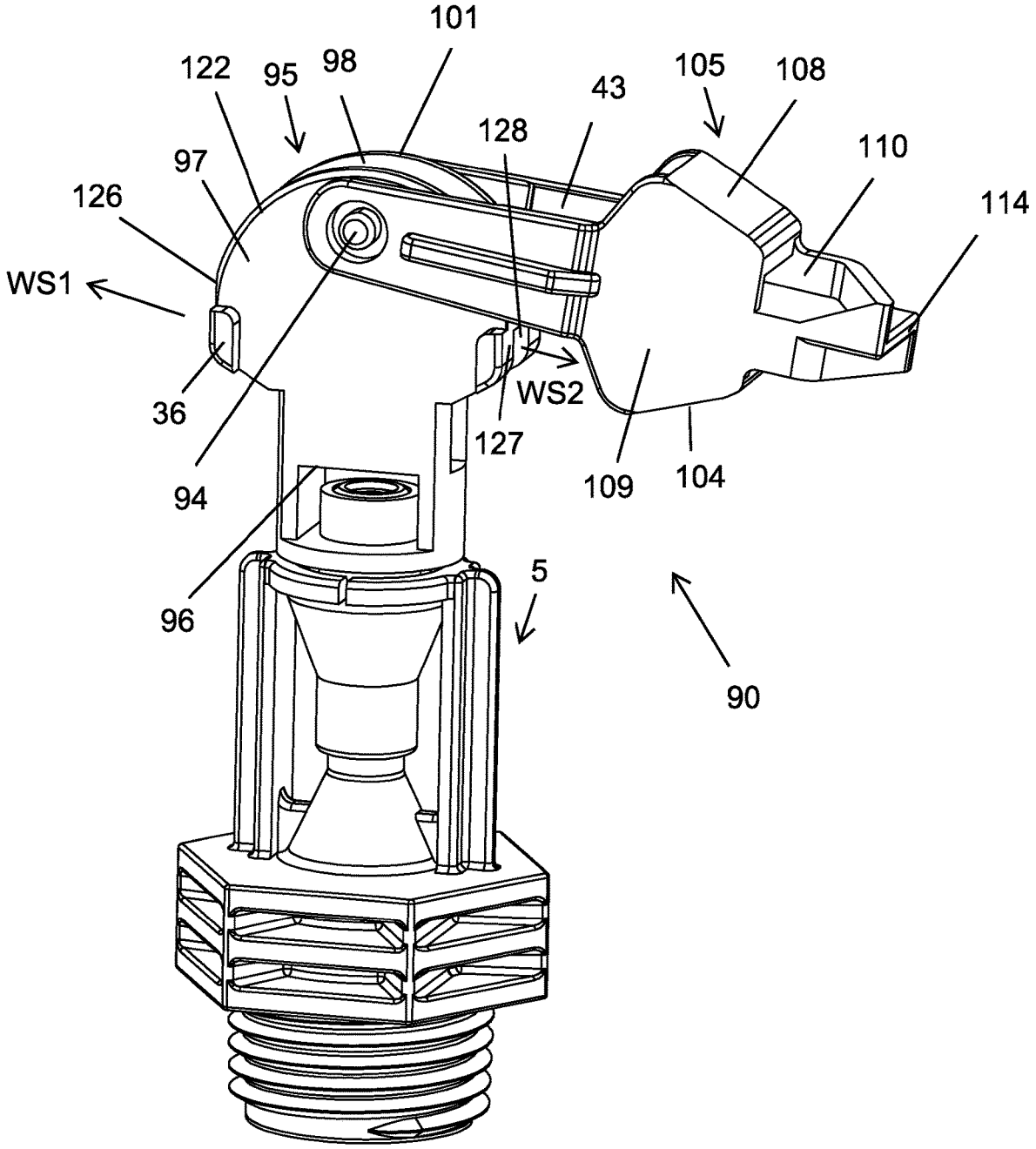
FIG. 12 is a perspective view from the front of another embodiment of a rotating sprinkler, showing the hammer component in an intermediate pivoted position.

As shown in FIG. 12, sprinkler 90 comprises the same base component 5 as sprinkler 10 of FIG. 1, as well as a head component 95 rotatably mounted on base component 5 having two mushroom shaped, mutually parallel and vertically oriented plates 97 and 98, and an invertable hammer component 105 configured with two oppositely oriented ramps 104 and 108, each of which extends inwardly between two mutually parallel and vertically oriented non-identical sidewalls 109 and 110.

Each of plates 97 and 98 has a continuous arcuate upper edge 122 that subtends an angle of approximately 180 degrees. Each end of arcuate upper edge 122 extends upwardly and continuously from a corresponding upper region of opposite planar and vertically oriented interconnecting walls 126 and 127, each of which configured similarly to interconnecting wall 32 of FIG. 1 but formed with a corresponding rectangular discharge port 128; however, an inverted U-shaped discharge port may also be provided. Sprinkler 90 generates two water streams, a first water stream WS1 being emitted from the discharge port of interconnecting wall 126 and a second water stream WS2 being emitted from the discharge port of interconnecting wall 127.

Proximate to a summit 101 of each of plates 97 and 98 is provided a corresponding outwardly extending post 94, to which is rotatably mounted a corresponding mounting arm 43 of hammer component 105, allowing hammer component 105 to follow the curvature of upper edge 122 while pivoting. Each of plates 97 and 98 has a height between summit 101 and bottom straight edge 96 that is approximately equal to 1.2 times its width between interconnecting walls 126 and 127. Since the interconnecting walls 126 and 127 have an integral stopper 36, the downward pivotal displacement of hammer component 105 is limited in each rotational direction. Hammer component 105, when downwardly pivoted, is able to undergo a cycle of water stream interception, transmission of a tangential force relative to the mounting tube to cause intermittent rotation of head component 15, and upwardly pivoted displacement. When hammer component 105 is upwardly pivoted to summit 101, it becomes inverted and is subsequently downwardly pivoted towards the other stopper 36.

Figure 13:
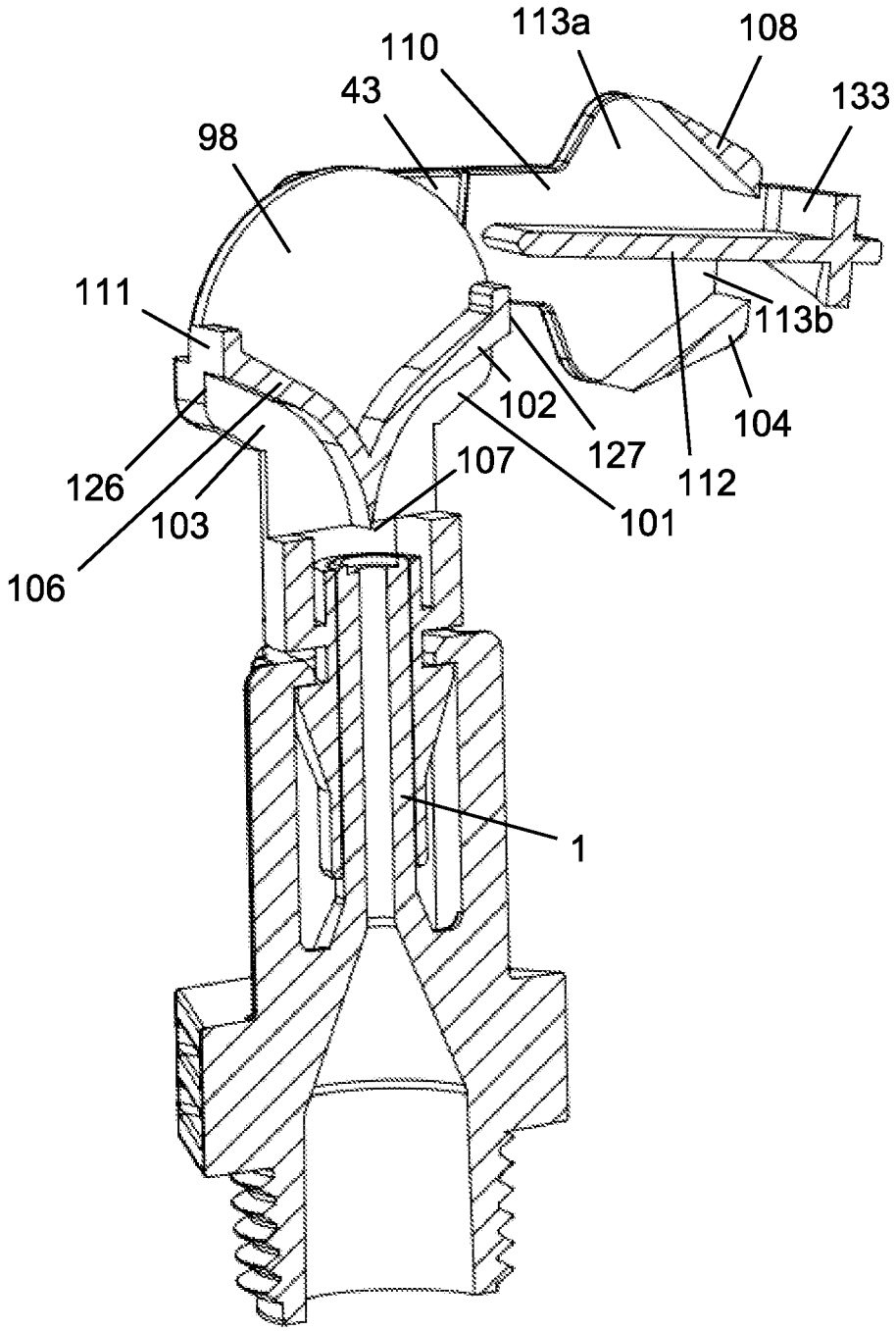
FIG. 13 is a perspective, vertical cross sectional view of the sprinkler of FIG. 12, cut along a plane between two plates of the head component.

As shown in FIG. 13, two curved channels 101 and 103 defined by arcuate guide elements 102 and 106, respectively, curving upwardly from a junction 107, e.g. a pointed junction, with guide elements 102 and 106 and bottom straight edge 96 of the corresponding plate extend inwardly between plates 97 and 98 of head component 95. Each guide element confines the discharged water along a desired path. A reinforcing element 111 may extend upwardly from a terminal end of the corresponding guide element. Junction 107 is located above the upper end of mounting tube 1 to ensure that all the water discharged from mounting tube 1 will be separated into two flows, a first flowing through channel 101 to the discharge port of interconnecting wall 127 and a second flowing through channel 103 to the discharge port of interconnecting wall 126.

Hammer component 105 will now be illustrated with reference to FIGS. 13-18.

For purposes of the following description, the proximal and distal directions relate to the orientation of hammer component 105 illustrated in FIG. 12, whereby interconnecting wall 127 is positioned forwardly to interconnecting wall 126 and the forward edge 114 of hammer component 105 is positioned forwardly to interconnecting wall 127. It will be appreciated that the invention is similarly applicable when hammer component 105 is inverted following pivotal displacement whereby forward edge 114 is positioned forwardly to interconnecting wall 126 and interconnecting wall 126 is positioned forwardly to interconnecting wall 127.

Figure 14:
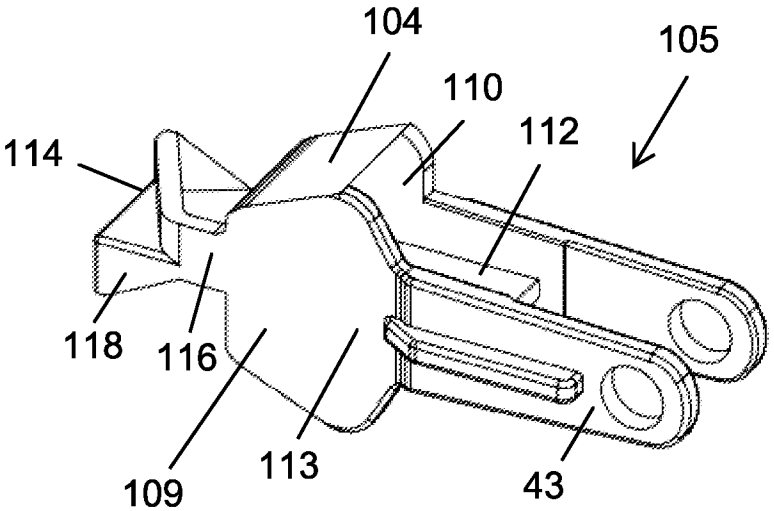
FIG. 14 is a perspective view from the front and bottom of the hammer component of FIG. 12, relative to the view of FIG. 12, when separated from the head component.

Hammer component 105 is configured with a planar deflecting surface 112 that is positioned inwardly between the two non-identical sidewalls 109 and 110. Each of sidewalls 109 and 110, which is positioned forwardly to a corresponding mounting arm 43, has a rearward ramp-delimiting sidewall region 113, an intermediate sidewall region 116, and a forward sidewall region 118, as indicated in FIG. 14. The two sidewall regions 113 are identical to each other, and deflecting surface 52 divides each sidewall region 113 into laterally symmetric sidewall portions 113*a* and 113*b*, as shown in FIG. 13, such that ramps 104 and 108 protruding inwardly from sidewall region 113 are also laterally symmetric to each other. Each of sidewall portions 113*a* and 113*b* may be, but not necessarily, identical to sidewall portion 44 of FIG. 6. Intermediate sidewall region 116 may have a square-like configuration, and forward sidewall region 118 may have a triangular configuration.

Figure 16:
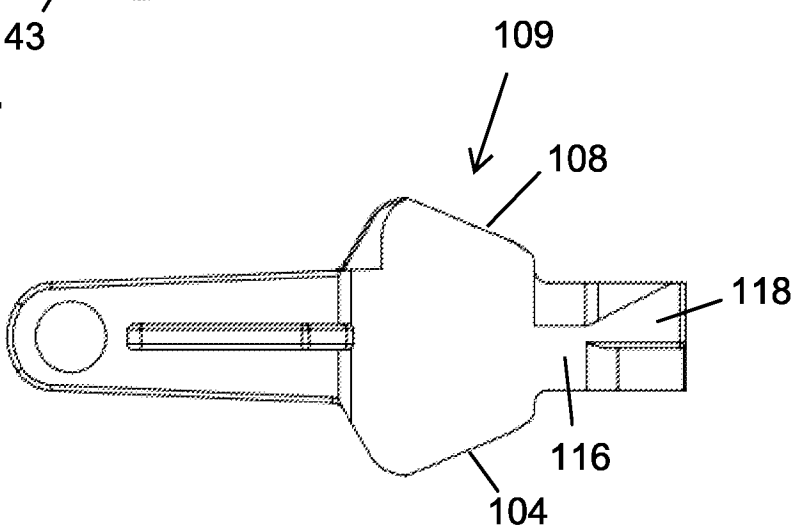
FIG. 16 is a front view of a second sidewall of the hammer component of FIG. 14, when inverted with respected to the orientation of FIG. 14.
Figure 15:
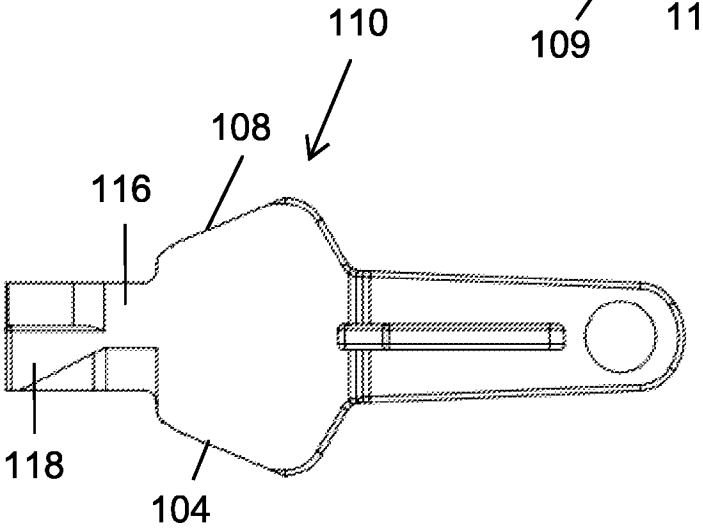
FIG. 15 is a rear view of a first sidewall of the hammer component of FIG. 14, when inverted with respected to the orientation of FIG. 14.

As shown in FIGS. 15 and 16, sidewall regions 116 and 118 of each sidewall 109 and 110 are of opposite lateral symmetry. That is, sidewall region 116 of sidewall 110 laterally extends only proximally from deflecting surface 112, while sidewall region 116 of sidewall 109 laterally extends only distally from deflecting surface 112. Also, sidewall region 118 of sidewall 110 laterally extends only distally from deflecting surface 112, while sidewall region 118 of sidewall 109 laterally extends only proximally from deflecting surface 112.

Figure 17:
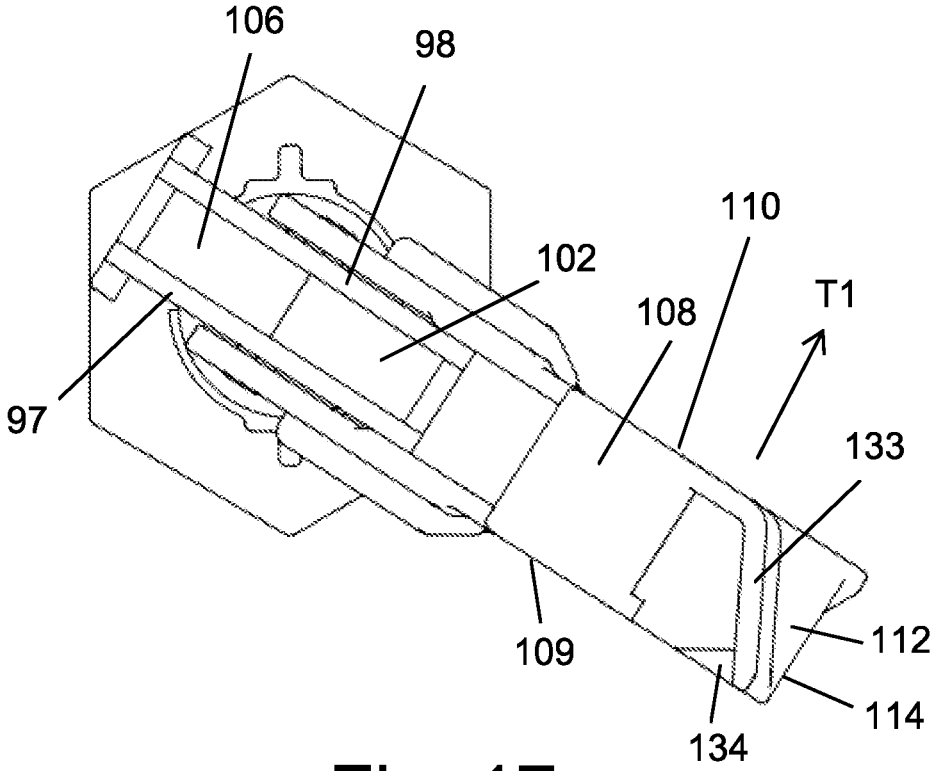
FIG. 17 is a top view of the sprinkler of FIG. 12, schematically illustrating a rotation-producing reaction force transmitted from the hammer component to the head component.

An elongated guiding surface 133 extends obliquely from the forward edge of sidewall region 116 of sidewall 110 adjoining ramp 108 to a coincidence region between the sidewall region 118 of sidewall 109 and forward edge 114 of deflecting surface 112. A sloped surface 134 interfaces between the proximal edge of the sidewall region 118 of sidewall 109, deflecting surface 112 and guiding surface 133. Thus when the interior between ramp 108 and deflecting surface 112 intercepts water stream WS1, the intercepted water stream is urged to flow upwardly and to impinge upon deflecting surface 112, causing hammer component 105 to pivot upwardly from stopper 36. The deflected water is urged to flow forcefully along elongated guiding surface 133 and along sloped surface 134, to exit hammer component 105 via the edge of the contiguous sidewall region 116 or 118 of sidewall 109. A reaction force T1 having a component that is opposite in direction to the direction of the exiting water and outwardly to sidewall 110 is produced, as shown in FIG. 17, causing head component 95 to rotate a limited circumferential distance in a clockwise direction about mounting tube 1 when hammer component 105 is inverted with respect to the illustrated orientation.

Figure 18:
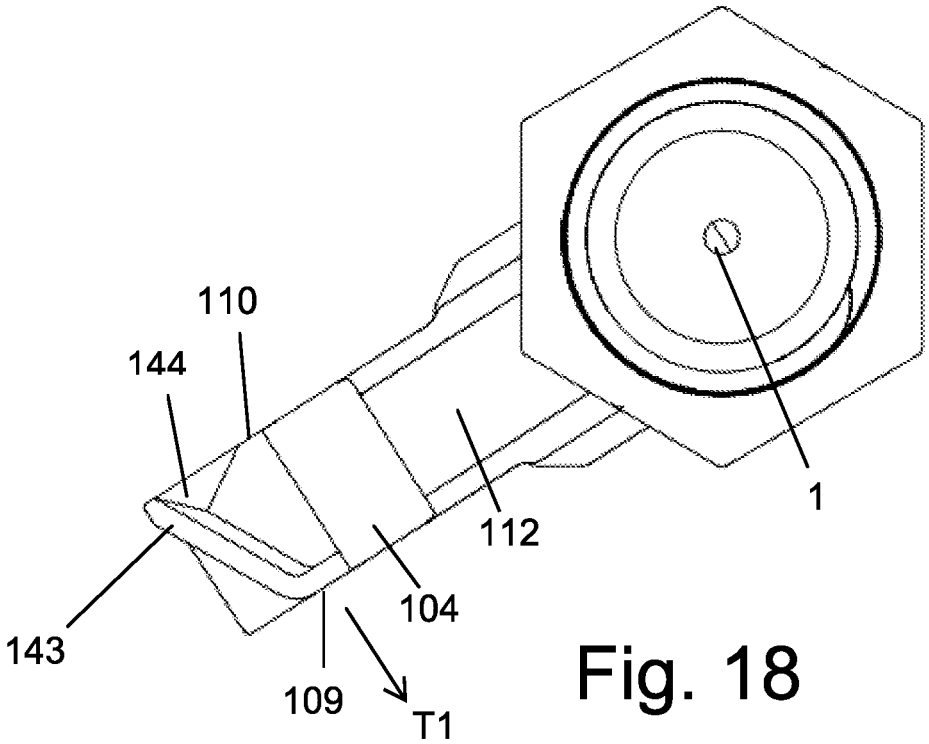
FIG. 18 is a bottom view of the sprinkler of FIG. 12, schematically illustrating a flow a rotation-producing reaction force transmitted from the hammer component to the head component.

Likewise, an elongated guiding surface 143 extends obliquely from the forward edge of sidewall region 116 of sidewall 109 adjoining ramp 104 to a coincidence region between the sidewall region 118 of sidewall 110 and forward edge 114 of deflecting surface 112. A sloped surface 144 interfaces between the distal edge of the sidewall region 118 of sidewall 110, deflecting surface 112 and guiding surface 143. Thus when the interior between ramp 104 and deflecting surface 112 intercepts water stream WS2, the intercepted water stream is urged to flow upwardly and to impinge upon deflecting surface 112, causing hammer component 105 to pivot upwardly from stopper 36. The deflected water is urged to flow forcefully along elongated guiding surface 143 and along sloped surface 144, to exit hammer component 105 via the edge of the contiguous sidewall region 116 or 118 of sidewall 110. A reaction force T1 having a component that is opposite in direction to the direction of the exiting water and outwardly to sidewall 109 is produced, as shown in FIG. 18, causing head component 95 to rotate a limited circumferential distance in a clockwise direction about mounting tube 1 with respect to the illustrated orientation. Accordingly, head component 95 is ensured of rotating in the same rotational direction irrespective of which interior space intercepts an emitted water stream.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. An impact-type rotating sprinkler, comprising:

a) a base component connected to a water source;

b) a rotating head component from which a water stream is emitted which is rotatably mounted on a vertical tubular element of said base component; and c) a gravitating hammer component pivotally mounted on said head component that causes intermittent rotary motion of said head component about a vertical rotation axis by intermittently engaging the emitted stream and providing in response a reaction force, wherein said gravitating hammer component comprises a deflecting surface and a ramping surface oriented obliquely with respect to said deflecting surface to define an interior space between said deflecting surface and said ramping surface, said gravitating hammer component configured to intercept the emitted water stream within said interior space when downwardly pivoted and to urge the intercepted water stream to flow upwardly along said ramped surface and to impinge upon said deflecting surface, causing the hammer component to pivot upwardly prior to being gravitated, wherein said gravitating hammer component is pivotally mountable on, and displaceable about, one or more horizontally oriented mounting elements of said head component, pivotal displacement of said gravitating hammer component being limited by two spaced stoppers protruding from said head component, wherein one of said two stoppers limits said gravitating hammer component to a downwardly pivoted position at which it is configured to intercept the emitted water stream, wherein said head component is configured with a discharge port and with a channel along which water from the water source is flowable and directable through said discharge port to said ramping surface when said gravitating hammer component is disposed at the downwardly pivoted position, wherein said gravitating hammer component is configured with one or more guiding surfaces protruding from said deflecting surface which urge the intercepted water stream to flow along a specific path forwardly to an impingement region until exiting said gravitating hammer component from said path in a direction that is tangential to said tubular element, a direction of the reaction force causing rotation of said head component being opposite to the direction of flow of the exiting water, wherein said gravitating hammer component is pivotally displaceable more than 90 degrees with respect to the downwardly pivoted position while said head component rotates in a same rotational direction regardless of an orientation of said gravitating hammer component, wherein said gravitating hammer component comprises first and second oppositely oriented ramping surfaces and is invertable, and first and second sets of guiding surfaces protruding from opposite faces of said deflecting surface which are configured to urge the water stream intercepted by said first and second ramping surfaces, respectively, to flow along the specific path.

2. The rotating sprinkler according to claim 1, wherein the head component is configured with first and second opposite discharge ports and with first and second channels by which water from the water source is divided and directed to said first and second discharge ports and to the first and second ramping surfaces, respectively, when the gravitating hammer component is disposed at a corresponding downwardly pivoted position.

* * * * *